United States Patent [19]

Leiponen et al.

[11] 4,267,877

[45] May 19, 1981

[54] APPARATUS FOR THE CONTINUOUS CASTING OF AN OBJECT OF PREDETERMINED WEIGHT OR SIZE

[75] Inventors: Matti O. Leiponen; Ossi T. Tonteri, both of Espoo, Finland

[73] Assignee: Outokumpu Oy, Helsinki, Finland

[21] Appl. No.: 965,022

[22] Filed: Nov. 30, 1978

[51] Int. Cl.[3] ..... B22D 25/04; B22D 39/04

[52] U.S. Cl. ..... 164/155; 164/130; 164/326

[58] Field of Search ..... 164/155, 130, 326

[56] References Cited

U.S. PATENT DOCUMENTS

| | | | |
|---|---|---|---|
| 2,522,031 | 9/1950 | Gavin, Sr. | 164/324 X |
| 3,187,394 | 6/1965 | Tama et al. | 164/155 |
| 3,648,758 | 3/1972 | Kreuz et al. | 164/155 |
| 3,659,644 | 5/1972 | DeBie | 164/128 X |
| 3,818,971 | 6/1974 | Schutz | 164/155 X |
| 3,833,048 | 9/1974 | Kreuz et al. | 164/155 |

*Primary Examiner*—Robert D. Baldwin
*Assistant Examiner*—J. Reed Batten, Jr.
*Attorney, Agent, or Firm*—Brooks, Haidt, Haffner & Delahunty

[57] ABSTRACT

An apparatus for the continuous casting of an anode plate into low-rimmed, open molds at the periphery of a rotating wheel, which apparatus comprises a casting ladle fitted adjacent to the molds for pouring molten metal into the molds, a feeding member for filling the casting ladle with molten metal between castings, measuring devices for determining the total weight of the casting ladle before and during casting, and control members for regulating the casting cycle on the basis of the measured total weight of the casting ladle, the casting ladle being fitted to swivel around a substantially vertical shaft between two positions so that the spout of the casting ladle moves with the mold below during the casting cycle and then back to a position above the next mold before the next casting cycle.

1 Claim, 3 Drawing Figures

Fig. 1
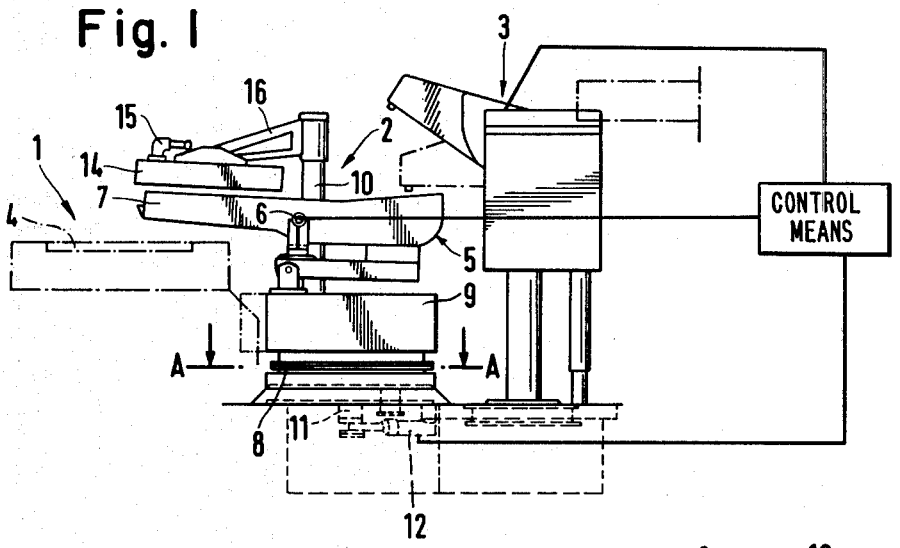
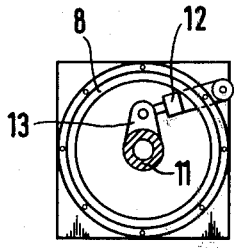
Fig. 3 (A-A)
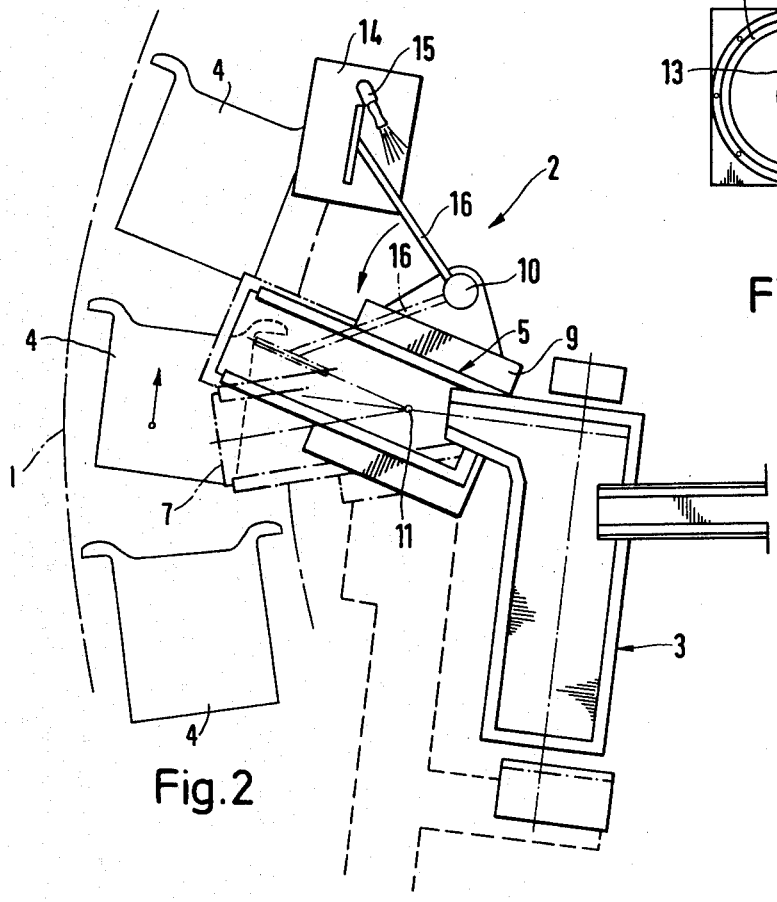
Fig. 2

APPARATUS FOR THE CONTINUOUS CASTING OF AN OBJECT OF PREDETERMINED WEIGHT OR SIZE

BACKGROUND OF THE INVENTION

The present invention relates to an apparatus for the continuous casting of a plate-like object of predetermined weight or size, such as an anode plate, into open, low-rimmed molds at the periphery of a rotating wheel, the apparatus comprising at least one casting ladle for pouring molten metal into the molds, a feeding member for filling the casting ladle with molten metal between castings, measuring devices for determining the total weight of the casting ladle before and during casting, and control members for regulating the casting cycle on the basis of the measured total weight of the casting ladle.

Previously known apparatus of the above type, e.g. suspended and weighed casting ladles above a continuously rotating casting wheel, have been structurally unsuitable for foundry conditions.

The object of the present invention is to provide a casting apparatus fitted in connection with a continuously rotating casting wheel and using previously known casting and weighing techniques experimented with in practice.

A continuously rotating wheel has certain advantages in terms of casting techniques and apparatus technology, but it also has great drawbacks, e.g. in removing the cast anodes from the wheel. The present invention comprises a practical method of casting flawless plates of a precise weight while the wheel is in continuous rotation.

SUMMARY OF THE INVENTION

According to the invention, this is achieved using an apparatus in which the casting ladle has been fitted to swivel between two extreme positions around a substantially vertical shaft so that the spout of the casting ladle moves along with the mold below it at a given moment during the casting cycle and then returns to a position above the next mold before the following casting cycle. Thus the movement of the series of molds can be continuous, in which case no splashing of the molten metal in a mold owing to acceleration or braking will occur, and furthermore, the molten metal is poured into the mold by a dependable, tried technique, which makes it possible to pour the molten metal into the mold with a minimum quantity of casting burr.

The essential idea of the invention lies in the fact that, contrary to what could be assumed without a thorough knowledge of the pouring action into the mold, splashing over the mold rims in the lateral direction is not caused by the pouring even if the casting ladle is only a few centimeters from the mold rims. In other words, centering the casting ladle in the lateral direction is not the most critical factor.

On the other hand, the distance of the casting edge from those rims of the mold which are parallel to the casting edge is critical. For this reason the previously known system, in which the pouring edge of the casting ladle is parallel to the radius of the wheel, the ladle being on top of the wheel and either fixed, or in some embodiments moving with the wheel, provides no advantage in terms of the pouring action itself. In this method, however, the structures of the apparatus are complicated and expensive, as well as difficult to use in production conditions.

The apparatus according to the invention can be made very simple and advantageous as the casting ladle, the measuring devices and the control members constitute one swiveling unit which can be fitted inside the mold circle.

DESCRIPTION OF THE DRAWING

FIG. 1 depicts a side elevation of the apparatus according to the invention;

FIG. 2 is a top view of the apparatus; and

FIG. 3 is a section along line A—A in FIG. 1.

DESCRIPTION OF THE PREFERRED EMBODIMENT

In the drawing, the endless, circular series of molds rotating in the horizontal plane is indicated by reference numeral 1 and the low-rimmed molds, open at the top, situated in it are indicated by reference numeral 4. The casting unit fitted adjacent to the mold circle 1, within its periphery, is indicated by reference numeral 2, and its purpose is to pour a precisely weighed quantity of molten metal into each mold 4 in turn. The batching ladle situated on the opposite side of the casting unit 2 in relation to the mold track 1 is indicated by reference numeral 3, and its purpose is to allow a periodic flow of a molten metal quantity sufficient for filling at least one mold 4 into the casting ladle 5 in the casting unit 2. During filling the casting ladle 5 is in its basic position, shown in FIG. 1, and the batching ladle 3 is in the position indicated by the dotted outline in FIG. 1.

The casting unit also has scales 9 measuring the total weight of the casting unit. On the basis of a signal given by the scales 9 the batching ladle 3 is raised when a sufficient quantity of molten metal has flowed into the casting ladle 5.

The casting ladle 5 has been fitted in the casting unit 2 so that it can be tipped, supported by a horizontal shaft 6 in such a manner that the molten metal contained in it can be poured through the spout 7 into the mold 4 below when the casting ladle 5 is tipped. The casting unit 2 is also supported by a bearing 8 so as to swivel around a substantially vertical shaft 11; thus the casting unit 2 swivels between two extreme positions, which are indicated in FIG. 2 by solid and dotted lines, respectively. The swivel movement of the casting unit is produced by the actuating cylinder 12 shown in FIG. 3, one end of the cylinder being attached to arm 13 protruding radially from the shaft 11 and the other end to the frame.

The apparatus according to the invention also has control devices, by means of which the tipping of the batching ladle 3 and the casting ladle 5 and the swivel movement of the casting unit are controlled and coordinated.

In addition, the casting unit 2 has been fitted with a cover 14 which has been fitted next to the casting ladle 5 and swivels, supported by the arm 16, around a vertical shaft 10; a burner 15 has been fitted to the cover 14. The cover 14 can be swiveled above spout 7 of the casting ladle to keep the molten metal in it hot so that the molten metal will not cool before or during casting.

When the casting ladle has been filled with a sufficient quantity of molten metal and the batching ladle 3 has been raised, the casting ladle 5 swivels about its horizontal shaft 6 to lower the spout 7 so that molten metal flows into the mold 4 below. At the same time the entire casting unit is swiveled about its vertical shaft 11 by the actuating cylinder 12, supported by the bearing 8, so that the spout 7 follows the movement of the mold below during the casting cycle. When the scales 9 indicate that the total weight of the casting unit 2 has decreased sufficiently, i.e., by the predetermined weight of the molten metal to be poured into the mold, the casting ladle 5, supported by its horizontal shaft 6, returns to its basic position, whereby its spout 7 rises and cuts the flow of molten metal into the mold 4. At the same time the actuating cylinder 12 returns the casting unit to its initial position to fill the casting ladle with a new batch of molten metal.

It is evident that there can be two casting units for the simultaneous casting of two anodes, whereby the capacity of the apparatus is naturally doubled.

What is claimed is:

1. An apparatus for the continuous casting of a plate-like object of predetermined weight or size into low-rimmed open molds at the periphery of a rotating wheel, the apparatus comprising: at least one casting ladle fitted adjacent to the molds for pouring molten metal into the molds, the casting ladle having a spout and being fitted to swivel around a substantially vertical shaft, which shaft is inside the periphery of the wheel for movement of the ladle between two positions so that the spout of the casting ladle moves with the mold below during a casting cycle and then moves back to a position above the next mold before a next casting cycle; feeding means for filling the casting ladle with molten metal between castings; measuring means for determining the total weight of the casting ladle before and during casting; and control means for regulating the casting cycle on the basis of the measured total weight of the casting ladle, said casting ladle, measuring means and control means constituting a single swiveling unit.

* * * * *